US005449230A

United States Patent [19]

Murray

[11] Patent Number: 5,449,230

[45] Date of Patent: Sep. 12, 1995

[54] STORAGE LOCKERS

[76] Inventor: Peter Murray, P.O. Box 1092, Garibaldi Highlands, British Columbia, Canada, V0N 1T0

[21] Appl. No.: 141,220

[22] Filed: Oct. 26, 1993

[51] Int. Cl.[6] ..... A47B 81/00

[52] U.S. Cl. ..... 312/285; 312/215; 194/247

[58] Field of Search ..... 312/199, 202, 285, 215, 312/289, 326, 329; 194/247, 350

[56] References Cited

U.S. PATENT DOCUMENTS

| | | | |
|---|---|---|---|
| 985,990 | 3/1911 | Farnsworth et al. | 194/350 X |
| 1,013,922 | 1/1912 | Batrick | 312/285 X |
| 1,260,763 | 3/1918 | Frix | 194/247 |
| 1,537,504 | 5/1925 | Sheedy | 312/285 X |
| 1,752,750 | 4/1930 | Mills | 194/247 X |
| 2,847,265 | 8/1958 | Kulik | 312/285 X |
| 3,193,074 | 7/1965 | Stackhouse | 194/247 |
| 3,826,378 | 7/1974 | Novak | 211/60 SK |
| 4,156,994 | 6/1979 | Stever et al. | 312/202 X |
| 4,494,805 | 1/1985 | Washburn | 312/215 |
| 4,957,196 | 9/1990 | Shiojima et al. | 194/239 |
| 5,082,101 | 1/1992 | Baker et al. | 194/350 |
| 5,129,501 | 7/1992 | Halsey et al. | 194/350 |
| 5,147,049 | 9/1992 | Schwendemann et al. | 211/70.5 |

FOREIGN PATENT DOCUMENTS

| | | | |
|---|---|---|---|
| 1316005 | 4/1993 | Canada | G07F 17/12 |
| 2558623 | 7/1985 | France | 194/350 |

*Primary Examiner*—James R. Brittain
*Assistant Examiner*—Janet M. Wilkens
*Attorney, Agent, or Firm*—Norman M. Cameron

[57] ABSTRACT

A storage locker apparatus includes a cylindrical structure with a plurality of angularly spaced-apart divider walls extending radially outwards. Each wall has an outer end and openings between adjacent outer ends of the walls. There are doors over each of the openings connected to the structure by hinges. Each door has a lock thereon. The lock may be coin operated.

8 Claims, 7 Drawing Sheets

STORAGE LOCKERS

BACKGROUND OF THE INVENTION

1. Field of the Invention

This invention relates to storage lockers and is useful in particular, to but not exclusively, storage lockers suitable for storing skis and accessory equipment or bicycles.

2. Description of Related Art

The storage of skis on or near ski hills is a constant problem for skiers. Skis can be very expensive and skiers are not permitted to take them into most food and rest facilities. Accordingly, they are usually put in unattended storage racks outside restaurants, warming huts and the like. This gives ample opportunity for thieves to get away with this valuable equipment.

Various types of lockable ski racks have been devised in the past. However, they usually require skiers to have special locks or special keys to initially open the locks to store the skis. Many skiers do not find it convenient to carry these. Furthermore, the skis are still visible and the locks are subject to tampering. In addition, there is usually no provision for storing other equipment such as poles, goggles, hats and gloves.

There also exists a need for secure storage for bicycles, for example mountain bicycles, which may be used on ski hills or other locations during summer, and for water skis and surf boards, for example in the vicinity of beaches.

It is accordingly an object of the invention to provide an improved storage locker apparatus which overcomes at least partly the above-mentioned problems associated with the prior art.

It is also an object of the invention to provide an improved storage locker apparatus which can be readily operated without requiring special keys or locks prior to storing skis.

It is another object of the invention to provide an improved and rugged storage locker apparatus which can be manufactured and sold for a relatively low cost.

It is also an object of the invention to provide an improved storage locker apparatus which is free standing and thus can be placed where required on a ski hill.

It is a further object of the invention to provide an improved storage locker apparatus device which is capable of displaying advertising and other information.

It is a still further object of the invention to provide an improved storage locker apparatus device which is capable of storing skis and other equipment so they are largely out of view.

SUMMARY OF THE INVENTION

In accordance with these objects, there is provided a storage locker apparatus which includes a cylindrical structure having a plurality of angularly spaced-apart divider walls extending radially outwards. Each wall has an outer end with openings between adjacent said outer ends. A plurality of doors are connected by hinges to the structure so each door is over one of the openings. There is lock on each door to provide a secured storage space between adjacent said walls and doors.

Preferably the means for locking includes a coin operated lock. For example, the lock may include a coin slot and a rotatable mechanism including a latch and means for preventing the mechanism from rotating unless a selected coin is placed in the coin slot. The means for preventing may include a catch which releasably engages the mechanism. There is means for guiding a specified coin inserted into the coin slot into contact with the catch to allow rotation of the member when a suitable key is in the keyhole.

The locker may have a coin receptacle adjacent the center of the structure. Coin chutes extend from each coin slot to the receptacle.

When compared to the prior art, the invention provides a storage locker with a simple, pleasing appearance which is suitably located at various locations on a ski hill including near restaurants and adjacent the bottom of the lower ski lifts. A relatively large number of skis can be stored in a small area. The skis are chiefly out of view and the lockers offer security for other equipment as well. The lockers are easily operated by coins and therefore are accessible to virtually to all skiers without requiring special locks or the like. The construction is rugged and simple as required for outdoor location under harsh winter conditions.

DESCRIPTION OF THE PREFERRED EMBODIMENTS

Figure 1:
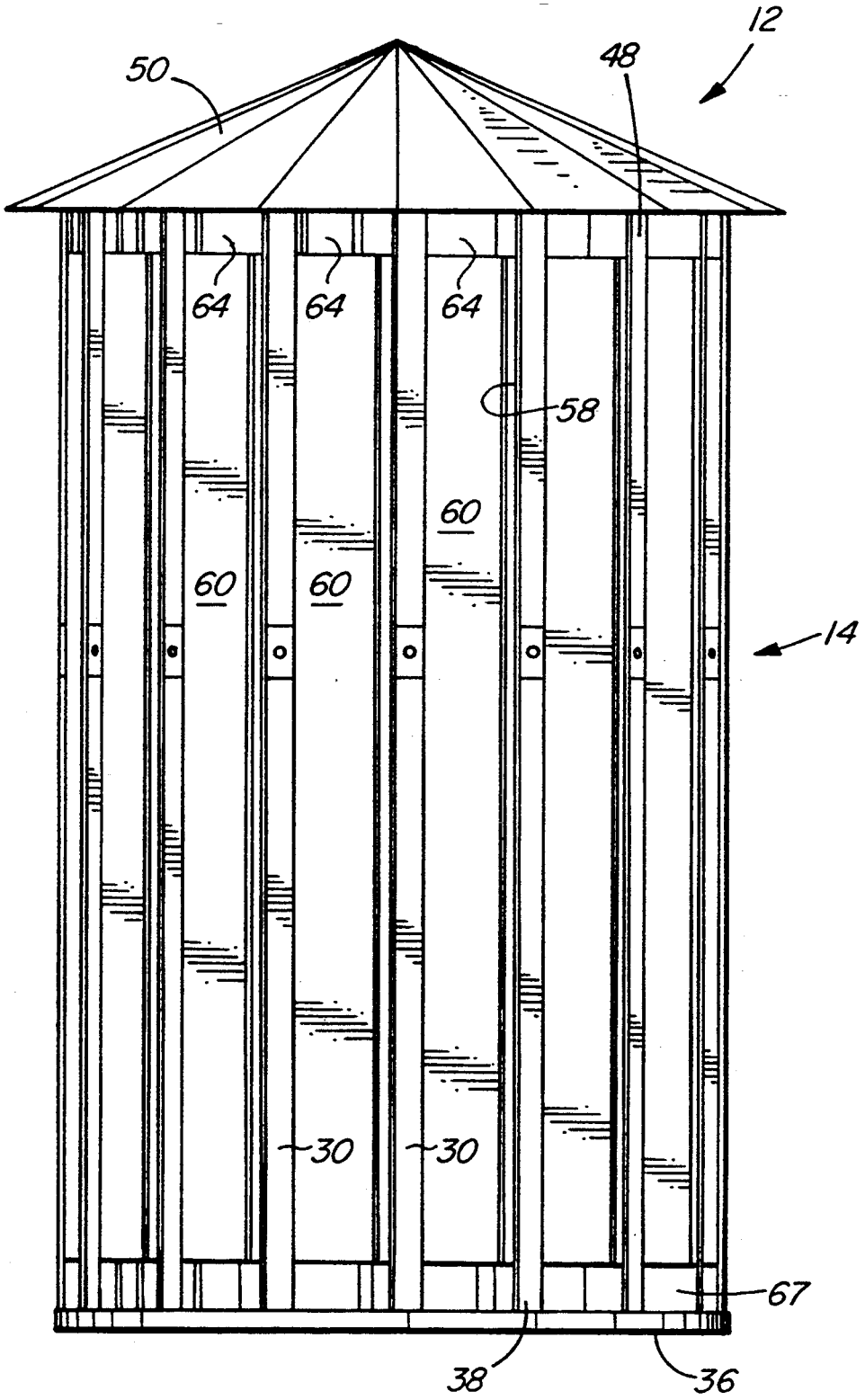
FIG. 1 is a side elevation of a storage locker apparatus according to an embodiment of the invention.
Figure 2:
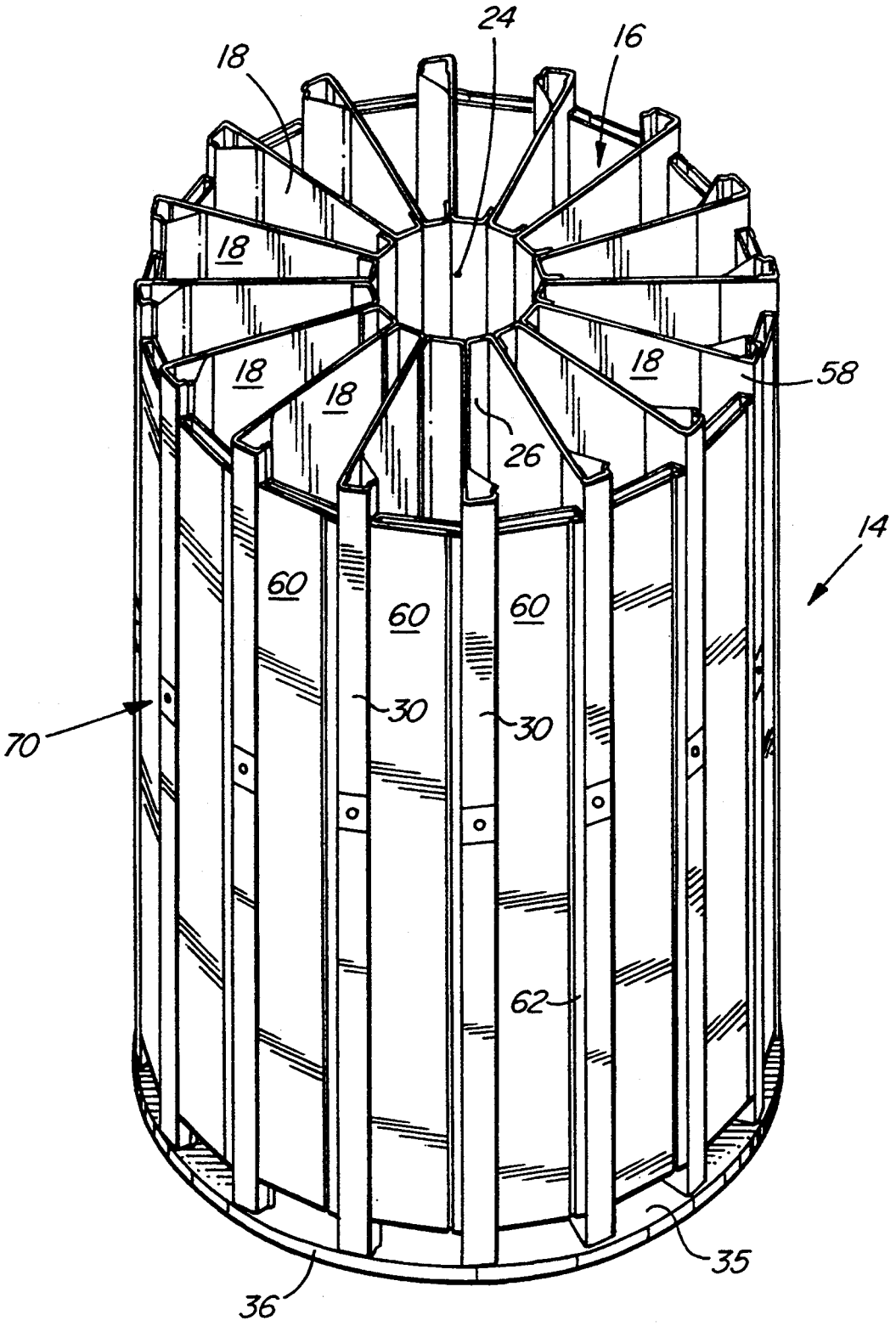
FIG. 2 is an isometric view of the apparatus of FIG. 1 with the top removed.

Referring first to FIGS. 1 and 2, these show a locker apparatus indicated generally by reference numeral 12 which includes a cylindrical structure indicated generally by reference numeral 14, the shape of which is best appreciated with reference to FIG. 2.

Figure 3:
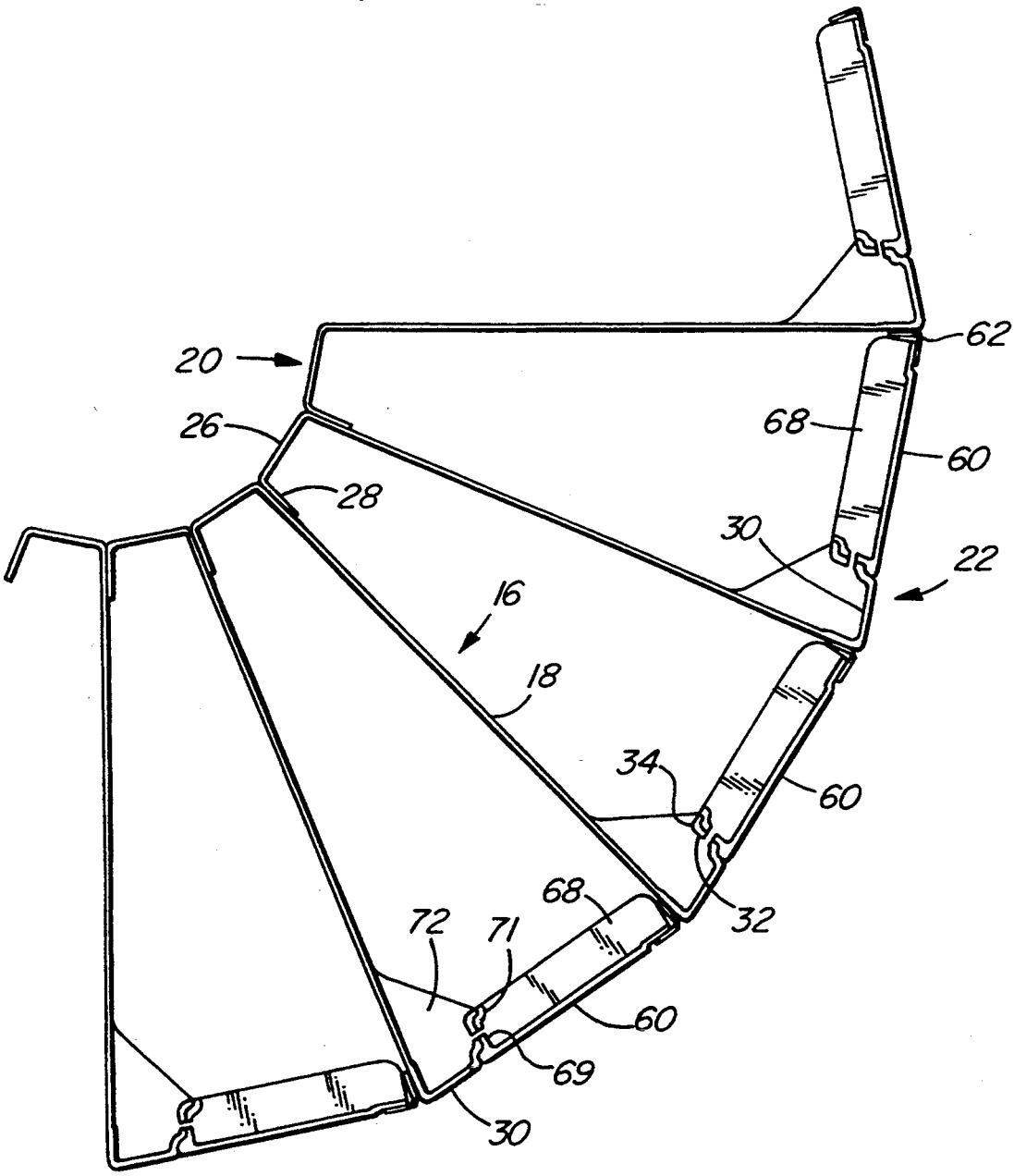
FIG. 3 is a fragmentary top plan view of one of the lockers thereof.

The structure is basically formed from a plurality of panels 16 which are generally Z-shaped in cross-section, as seen in best in FIG. 3. There are sixteen such panels in this embodiment although the number can be varied according to the number and size of lockers required. The panels in this embodiment are made of glass fibre-reinforced plastic, although other rigid materials, such as galvanized steel, could be substituted. The main portion of each panel consists of a divider wall 18 which extends from inner end 20 to outer end 22 of each panel. With reference to FIG. 2, it may be seen that the divider walls 18 extend radially outwards from center 24 of the apparatus.

Each panel also has at its inner end 20 an inner wall 26, shown best in FIG. 3, which extends away from the divider wall at an angle slightly greater than 90°. In this instance the angle is about 101°, although this depends upon the number of panels employed. Each inner wall 26 has a flange 28 extending therefrom, again at an angle of approximately 101° for this embodiment. The flange is connected to the divider wall 18 of an adjacent panel 16. In the preferred example, this is effected by pop rivets, although adhesives, screws or other such connections could be substituted. Similar means are used in other locations for connections as well.

Each panel also has an outer wall 30 at the outer end 22 of the panel. The outer wall 30 extends at an angle less than 90° from the divider wall 18, in this instance approximately 79°. A flange 32 extends radially inwards from the outer wall 30 at an angle slightly greater than 90° in the preferred example. There is a lip 34 which extends from the flange 32 generally parallel to outer wall 30, but in the opposite direction.

Figure 6:
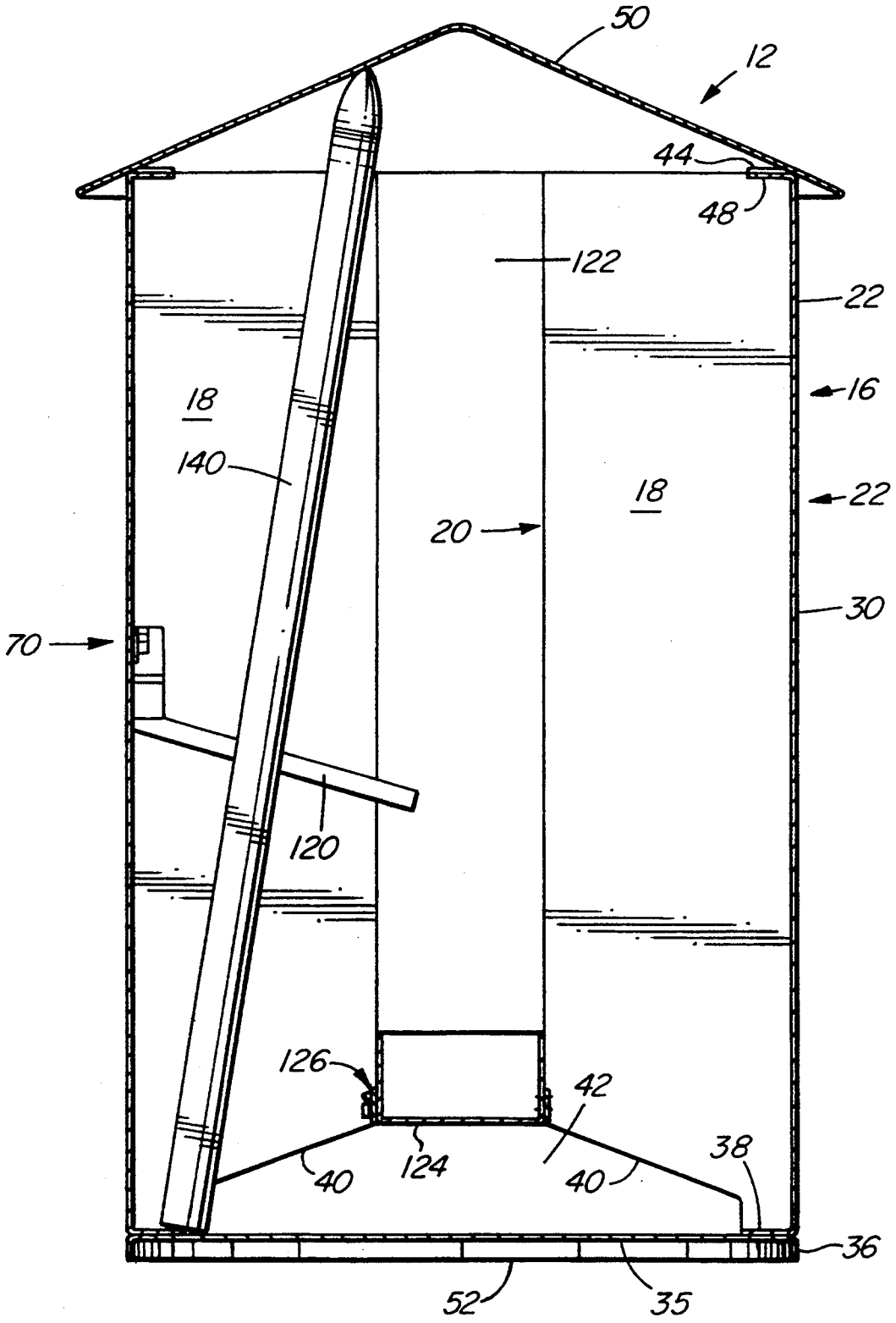
FIG. 6 is a simplified diametrical section of the locker apparatus.

The locker apparatus 12 has a flat circular bottom 35, which is formed with a downturned peripheral flange 36, and which receives bottom ends 38 of the panels as best seen in FIG. 6.

With reference to FIG. 6, it may be seen that the panels 16 are generally rectangular in elevation. However, there is a recess 42 formed, near the bottom end 38 of each panel by an edge 40 which extends angularly downwards from the inner end 20 of each panel to a position above the bottom end 38. Edge 40 terminates inwardly from outer end 22. Recess 42 thus formed allows communication between adjacent lockers for the purpose of removing snow and the like.

Ring 44 is fitted on top ends 48 of the panels as seen in FIG. 6. A generally conical top 50 is connected to the ring 44 to cover the entire apparatus.

It may be seen with reference to FIGS. 1 and 2 that a rectangular opening 58 is formed between the outer ends 22 of adjacent panels 16. A rectangular door 60 is provided in each opening 58 and is connected to the structure by a hinge 62, as shown in FIG. 3. The hinges 62 preferably extend the whole lengths of the doors, but a plurality of spaced-apart hinges on each door could be substituted.

As may best be seen in FIG. 1, each door extends from a position near the top ends 48 of the panels to near the bottom ends 38. However, there is a space 64 at the top of each door and a similar space 67 at the bottom of each door to allow for the circulation of air and removal of snow and other debris, respectively. Each door has two horizontal stiffening flanges 68 in this preferred embodiment, one at the top and the other at bottom of the door. Each door also has a vertical outer flange 69, which as shown in FIG. 5 is formed with a vertical lip 71 for nesting engagement with a complimentary vertical recess 75 in the flange 32, and with a vertical recess 73 for nesting engagement with the lip 34 of the flange 32, to prevent the door swinging inwardly.

Figure 8:
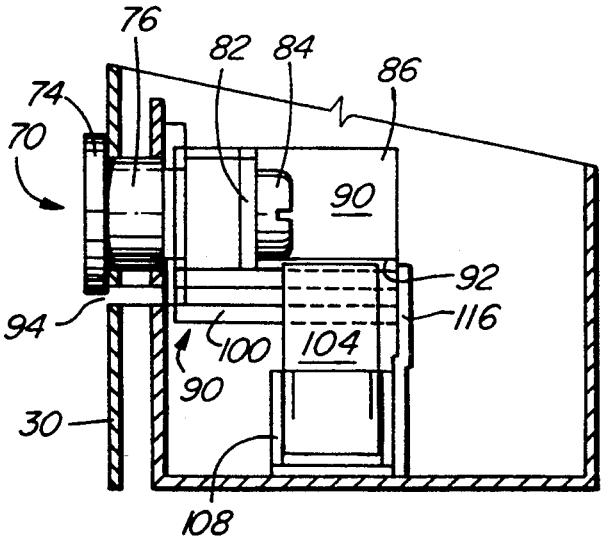
FIG. 8 is a top plan view of the lock mechanism.
Figure 9:
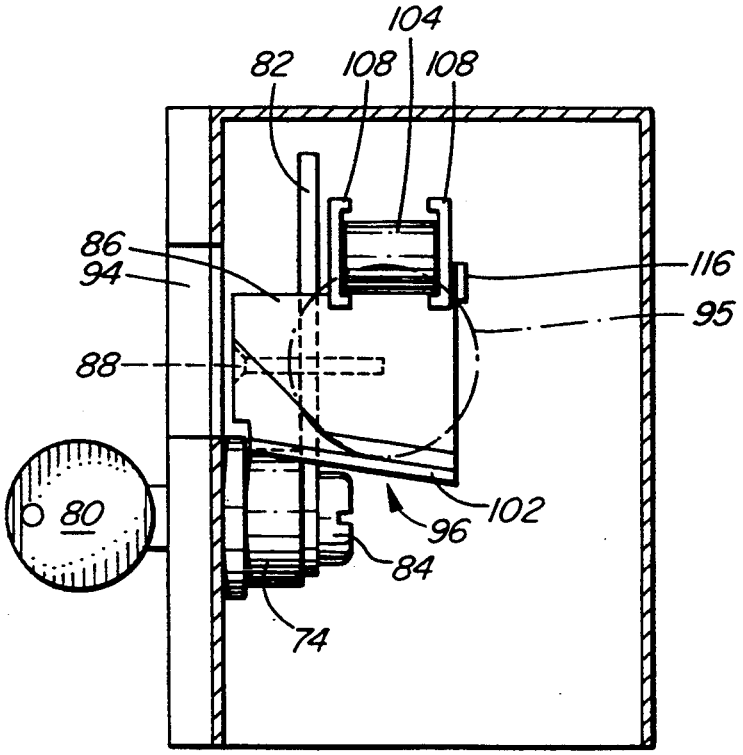
FIG. 9 is a side elevation of the lock mechanism.

Each door is provided with a lock mechanism shown generally at 70 in FIG. 2. The lock mechanisms 70 are mounted inside outer wall 30 of each panel above a strengthening flange 72 shown in FIG. 3. The lock mechanism is best appreciated with reference to FIGS. 7, 8 and 9. Each mechanism includes a standard cam lock 74 received in an aperture 76 in the outer wall 30 of one of the panels as best seen in FIG. 8. Each of the locks has a key hole 78, shown in FIG. 7, for receiving a key 80 as shown in FIG. 9. There is a bar 82 connected to each lock by a screw 84 as seen in FIGS. 8 and 9. The bar rotates when the lock is turned. When the bar is rotated 90° clockwise from the position of FIG. 7, it engages a slot 83 in the flange 69 of the door as shown in FIG. 5 and prevents it from pulling outwards.

Normally, however, rotation of the lock is prevented. This is accomplished by means of a cam-like member 86 which is connected to the bar 82 by a screw 88. The member 86 has a convexly curved top 90 provided with a lip 92 shown in FIG. 7.

Figure 5:
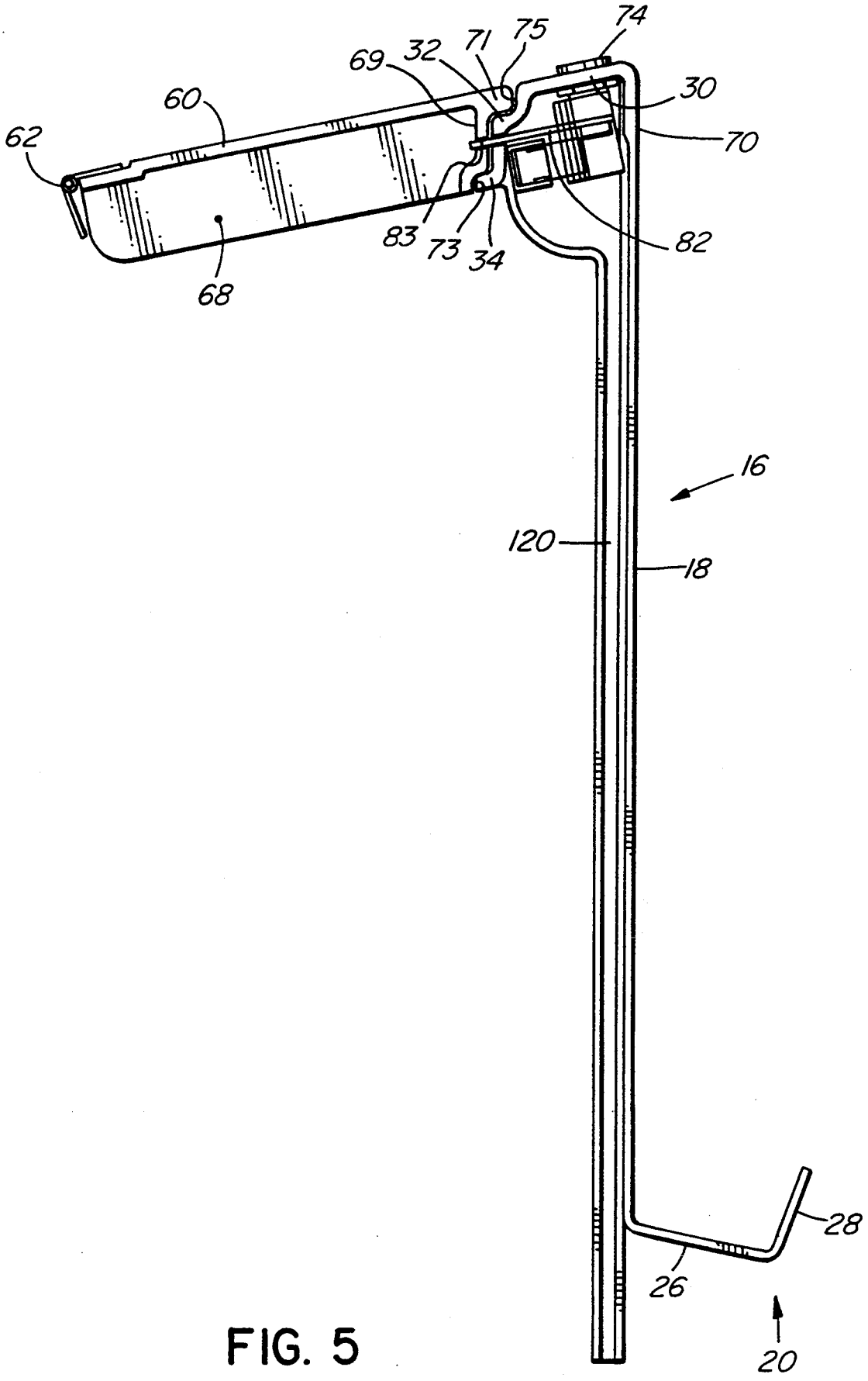
FIG. 5 is a top plan view of one of the doors and one of the walls thereof, showing one of the coin chutes.
Figure 7:
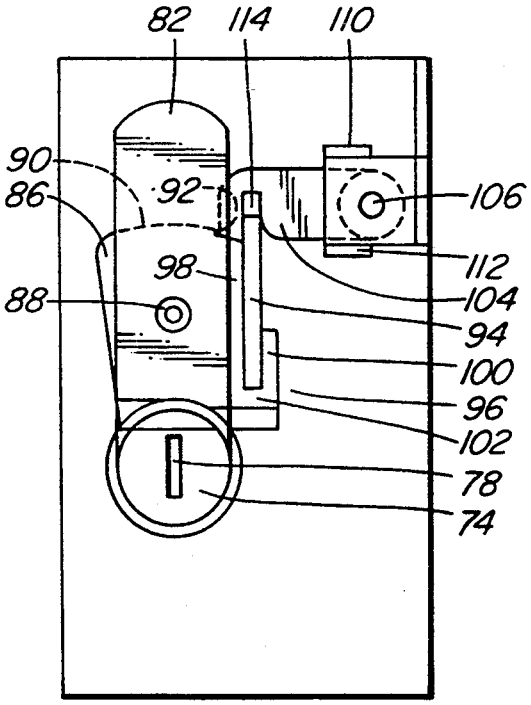
FIG. 7 is a front elevation of the lock mechanism of the apparatus of FIG. 1.

There is coin slot 94 shown in FIGS. 5, 7 and 9 in front each of the lock mechanisms in the outer wall 30 of the appropriate panel. The coin slot is sized to receive a suitable coin 95. A channel-shaped coin receiver 96 is connected to the cam-like member 86 and the bar 82 for rotation therewith. As shown in FIG. 7, the receiver 96 generally has two spaced-apart sides 98 and 100 and a bottom 102. The bottom 102 is angled downwardly away from the slot 94 as shown in FIG. 9. Thus, the coin 95, when inserted through the slot 94, fits between the sides 98 and 100 and rolls down the bottom 102.

There is a catch 104 in the form of a lever which is pivotally connected to the structure by a pin 106 shown in FIG. 7. The catch is mounted in a bracket 108 with top and bottom bars 110 and 112 which limit upward and downward movement of the catch, as may be appreciated from FIG. 7. The catch is somewhat hook-shaped, having a slot 114 in the bottom thereof facing coin receiver 96. Thus, as the coin 95 rolls down bottom 102 of the receiver 96, it is received within the slot 114 and raises the catch. Normally, the catch engages lip 92 as shown in FIG. 7. The correct size coin however lifts the catch and disengages it from the lip, allowing the lock to be turned by the key.

There is a coin sizer bar 116 shown in FIG. 8 and 9 connected to the bracket 108 which prevents the coin from rolling too far down the bottom 102 of the receiver, provided that the coin is of sufficiently large diameter. Coins which are too small can pass beneath the bar 116 without raising the catch 104.

The locks are simple, rugged and less expensive than conventional coin operated devices, and the cam-like member 86 and the catch 104 are made of plastic to counteract freezing.

When the appropriate sized coin is received and the catch is lifted, the key can be turned to lock one of the lockers or storage spaces located between adjacent divider walls 18 of the panels. The key can be removed only when the locker is locked. When the lock turns, the coin 95 falls off the receiver onto one of the chutes 120 shown in FIGS. 4 and 6.

Figure 4:
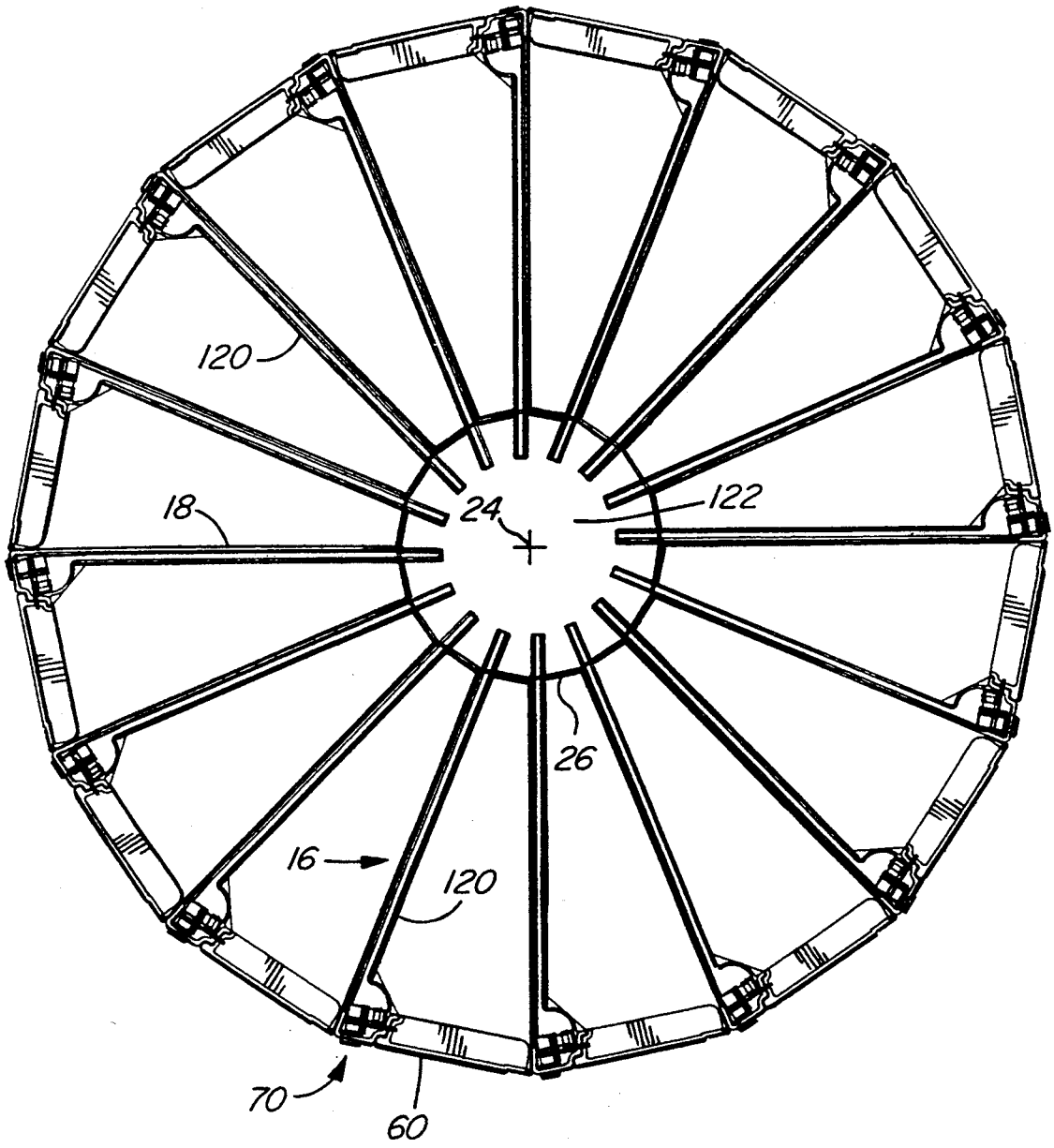
FIG. 4 is a top plan view of thereof with the top removed.

Each coin chute 120 is in the form of a channel extending downwardly from one of the lock mechanisms 70 to cylindrical space 122 at the center of the apparatus. Each coin chute extends along one of the side walls 16. This is best shown in FIGS. 4 and 6. As shown in FIG. 6, the bottom of the cylindrical space 122 is formed by a downwardly removable tray 124, which is retained by a clasp fastener and padlock indicated generally by reference numeral 126. The coins which are deposited from the coin chute 120 into the cylindrical space 122 drop onto and are collected by the tray 124. The tray 124 can be removed downwardly into the space between edges 40 of the panels 16 and the bottom 35 of the locker apparatus. If desired it can be removed from the apparatus through one of the doors 60.

In use, skis 140 arc stored in each of the lockers of the apparatus which are defined by the spaces between adjacent panels 16 as well as the doors, top 50 and bottom 52 of the unit.

The locker apparatus 12 may alternatively be used to store water skis or surf-boards, and may be provided with hooks or other suspension means for holding bicycles.

It will be understood by those skilled in the art that many of the details provided above are by way of example only and are not intended to limit the scope of the invention which is to be interpreted with reference to the following claims.

What is claimed is:

1. A storage locker apparatus comprising:

a cylindrical structure including a plurality of angularly spaced-apart divider walls extending radially outwards, each said wall having an outer end with openings between adjacent said outer ends;

a plurality of doors;

means for hingedly connecting each said door to the structure over one said opening; and means for locking each said door over one said opening to provide a secured storage space between adjacent said walls and said doors, the means for locking including a coin operated lock with a coin slot and a rotatable mechanism including a latch and a keyhole and means for preventing the mechanism from rotating unless a selected coin is placed in the coin slot, the means for preventing including a catch which releasably engages the mechanism and means for guiding a coin inserted into the coin slot into contact with the catch to allow rotation of the mechanism when a suitable key is inserted in the keyhole, the means for guiding including a channel-shaped coin receiver connected to the rotatable mechanism and being rotatable therewith, the receiver being sloped downwardly towards the latch and being spaced-apart therefrom.

2. An apparatus as claimed in claim 1, wherein the structure has a top.

3. An apparatus as claimed in claim 2, wherein the top is conical.

4. An apparatus as claimed in claim 1, wherein the means for preventing includes a convexly curved cam on the rotatable mechanism having a lip thereon, the catch being a lever pivotally mounted behind the coin slot which releasably engages the lip and is deflected away from the lip by the specified coin inserted into the coin slot.

5. An apparatus as claimed in claim 1, wherein the structure has a center and the lock has a coin receptacle adjacent the center of the structure and coin chutes extending from each said slot to the receptacle.

6. A coin operated lock apparatus comprising a rotatable mechanism with a latch and a lock with keyhole and means for preventing the mechanism from rotating unless a selected coin is inserted into the mechanism, the means for preventing including a catch which releasably engages the mechanism and means for guiding a coin into contact with the catch to allow rotation of the mechanism when a suitable key is inserted into the keyhole, the means for preventing further including a convexly curved cam on the rotatable mechanism having a lip thereon, the catch being a lever pivotally mounted and releasably engaging the lip, the lever being deflected away from the lip by the specified coin, the means for guiding including a channel-shaped coin receiver connected to the rotatable mechanism and being rotatable therewith, the receiver being sloped downwardly towards the lever and being spaced-apart therefrom.

7. An apparatus as claimed in claim 6, wherein the lever has a slot for receiving the coin which faces the coin receiver.

8. A storage locker apparatus comprising:

a cylindrical container with a conical top, a bottom, a plurality of angularly spaced-apart interior divider walls, outer doors connected to the container between the divider walls, a tubular member at the center of the container extending from the top to the bottom, a coin receptacle in the tubular member, a coin lock on the container adjacent each said door, and a coin chute extending from each said lock to the coin receptacle and angled downwardly towards the receptacle.

* * * * *